US005890338A

United States Patent [19]

Rodriguez-Ferré

[11] Patent Number: 5,890,338

[45] Date of Patent: Apr. 6, 1999

[54] STRUCTURE FOR CONSTRUCTING HOUSES DESIGNED FOR CHILDREN TO PLAY

[76] Inventor: José Manuel Rodriguez-Ferré, Poligono Industrial Derramador, IBi, Spain, 03440

[21] Appl. No.: 680,656

[22] Filed: Jul. 16, 1996

[30] Foreign Application Priority Data

Jul. 17, 1995 [ES] Spain ..... 9501969 U

[51] Int. Cl.[6] ..... E04B 2/00

[52] U.S. Cl. ..... 52/582.1; 52/27.5; 52/36.2; 52/285.1; 52/316; 256/26; 446/476; 446/479; D21/114

[58] Field of Search ..... 52/27.5, 36.2, 52/262, 264, 270, 272, 282.1, 282.3, 285.1, 316, 315, 314, 582.1; 256/25, 26; 446/476, 478, 479, 481; D21/114, 115, 116, 118, 119

[56] References Cited

U.S. PATENT DOCUMENTS

| | | | |
|---|---|---|---|
| D. 87,610 | 8/1932 | Weiss | D21/114 |
| D. 176,551 | 1/1956 | Patterson | D21/114 |
| D. 251,265 | 3/1979 | Shorten | D21/114 |
| D. 281,986 | 12/1985 | Nottingham et al. | D21/114 |
| D. 293,699 | 1/1988 | Thornell | D21/114 |
| D. 334,221 | 3/1993 | Swanger | D21/114 |
| 2,600,900 | 6/1952 | McNeill | 52/270 X |
| 2,678,705 | 5/1954 | Haines et al. | 52/264 X |
| 3,020,601 | 2/1962 | Stambaugh et al. | 52/262 |
| 4,021,960 | 5/1977 | Walmer | 446/104 |
| 5,437,573 | 8/1995 | Rodriguez-Ferre | 472/116 |
| 5,544,870 | 8/1996 | Kelley et al. | 446/478 X |

OTHER PUBLICATIONS

Published Application for Canadian Patent; 2,112,025; Rodriquez–Ferre. Jun. 1994.

"Play 'N Fold Clubhouse", Today's Kids: Wish Book, p. 3, 1994.

"Log Cabin", Evergreen Play House, and Country Cottage, Little Tikes: Toys That Last, pp. 56, 57, and 59 (respectively), 1994.

"Drive–In Playhouse", Step 2: A Step Beyond, p. 22, 1994.

*Primary Examiner*—Carl D. Friedman
*Assistant Examiner*—Kevin D. Wilkens
*Attorney, Agent, or Firm*—Gottlieb, Rackman & Reisman, P.C.

[57] ABSTRACT

A modular structure for constructing houses is designed for children to play. The structure includes moulded material panels which are connected with the assistance of corner parts through conjugated members built into the panels. The panels have an outer embossed surface resembling stonework, windows and door openings in which the relevant leaves or panes are articulated. The facade parts form a top angle for supporting saddle roof parts above. The modular structure is used for mounting houses for children to play within and it is accessible for children. The house may also have auxiliary rotatable simulated domestic elements, such as a vertical mirror that rotates down to be a horizontal table top.

7 Claims, 4 Drawing Sheets

STRUCTURE FOR CONSTRUCTING HOUSES DESIGNED FOR CHILDREN TO PLAY

DESCRIPTION

The present invention relates to a structure for constructing houses designed for children to play.

The applicant for the present invention is the holder. of Spanish Patent application P9202609 that relates to a structure for children to play which covers, as a novel feature, the special shape of its constituent parts, which comprise modular parts of a hard moulded material, preferably plastic, provided with means, obtained at the moulding stage proper, with which such parts may be interconnected, by fitting, slipping and/or socketing. These means are therefore the only link connecting said modular parts, allowing a three-dimensional structure to be mounted simply and without screws, its size being suitable and sufficient to enable children to be housed therein and/or supported thereby when playing.

The said links connecting the modular parts allow the structures to be made to be mounted and dismounted following a simple method that can be easily carried out by an adult. The structure obtained can be extended by means of additional modules or else associating it to other structures so as to obtain a complex which improves playing conditions, all in accordance with the surface available for the same to be set, which surface must be flat.

The basic modular parts comprising the said Patent application number P9202609 consist of substantially flattened rectangular shaped bodies made of a moulded material, their working position being vertically upright, and having short extensions of the same material projecting from their sides, which are bent with respect to the main part at different angles, two by two, thereby for vertical guides to be provided between such extensions for axially sliding edges having a round section existing in other panel-shaped parts. The result is an angular assembly between the upwardly rectangular parts, forming corners and chamfers, and the panel parts, forming a right angle therebetween, thereby to enable the formation of regular prismatic volumetric bodies, to which other auxiliary parts are affixed, making up slides, ladders, seats, seesaws and the like.

The object of the present invention relates to a structure for constructing houses, applicable for children to play variously, which basically relies on the system of assembly covered by the said priority Patent.

Now, therefore, the present invention consists of the basic parts protected in the earlier Patent, which have nevertheless been provided with a particular shape and structure which, together with new parts, enable a building or country cottage to be formed comprising a prismatic body provided with a saddle roof. The special shape of the components used in the structure make said prismatic body truly appear as a cottage, to which end they have embossments resembling stonework, openings for fitting window and door parts, all of which may be hinged, and complementary parts, removable at will, and which may be situated inside or outside the cottage. The precinct making up the building has sufficient capacity to house one or several children, who may enter the same through the door, and may look out through the relevant windows.

A sheet of drawings is attached to the specification for ease of explanation, showing an embodiment that is cited as an example.

With reference to the figures, the embodiment shows a structure for constructing houses designed for children to play, of the kind comprising upwardly rectangular shaped modular parts -1- made of a hard moulded material, preferably plastic, provided on their longitudinal sides with extensions of the same material, designated -2- and -3-, lying at two angles of a different graduation to the body of part -1-, thereby for such extensions -2- and -3- to constitute, on their counter-opposed faces, a guide in which edges -4- of suitable section that extend on the longitudinal sides of panels -5-, -6- and -7- slide snugly. The foregoing organisation allows a regular prismatic body to be obtained in which its faces consist of panels -5- and -6- and two modular panels in the likes of -7-, whereas parts -1- establish the connections therebetween, such parts -1- being located at the corners, forming a chamfer.

The modular panels -7- make up the frontispiece or facade of the house, with a triangular top **-7*a*- which includes a round window -8-. The panels -5- and -6- are rectangular. The top -7*a*- and the panels -5- and -6- provide a seat for a saddle roof consisting of modular panels -9-, provided on the side representing the ridge or edge of the roof with material extensions -10- to form a connection by fitting, using a spigot -11- that fits in a female housing, that is not shown, existing in the adjacent extension of the other modular part. These modular parts -9- have an embossment -12- on their visible face resembling the tiles or components of a traditional roof, whereas their undersides have ledges, not shown, which serve as an abutment against the top edges of the modules -5- and -6-, in order to allow the functional arrangement of the panels -9-**.

Parts -5-, -6- and -7- have an embossment -13- on their visible outer face resembling stone or brickwork. Part -5- conforms a full-center arch opening -14- for housing a door -15- having a similar contour and provided with a keyhole -16- for an elementary lock driven by a key -17- to be actuated. A hole -18- resembles the mouth of a letter-box. The door -15- has two coaxial spigots or pins -23- defining the turning axis, which are housed in two female cavities existing in the opening -14-.

Part -6- has a chimney -19- on its outer visible face, and below two holes -20- to receive two bits -21- projecting from the side of a flat part -22- imitating a barbecue plate.

The modular parts -7- have a window opening -24- in which parts -25- are coupled with coaxial pins -26- that define their turning axis, together with female holes existing in the opening -24-. Said parts -25- have recesses -27- serving as handgrips to handle the same.

FIGS. 2 to 9 show the successive stages for mounting the structure, in accordance with a simple method that an adult may easily carry out.

Figure 1:
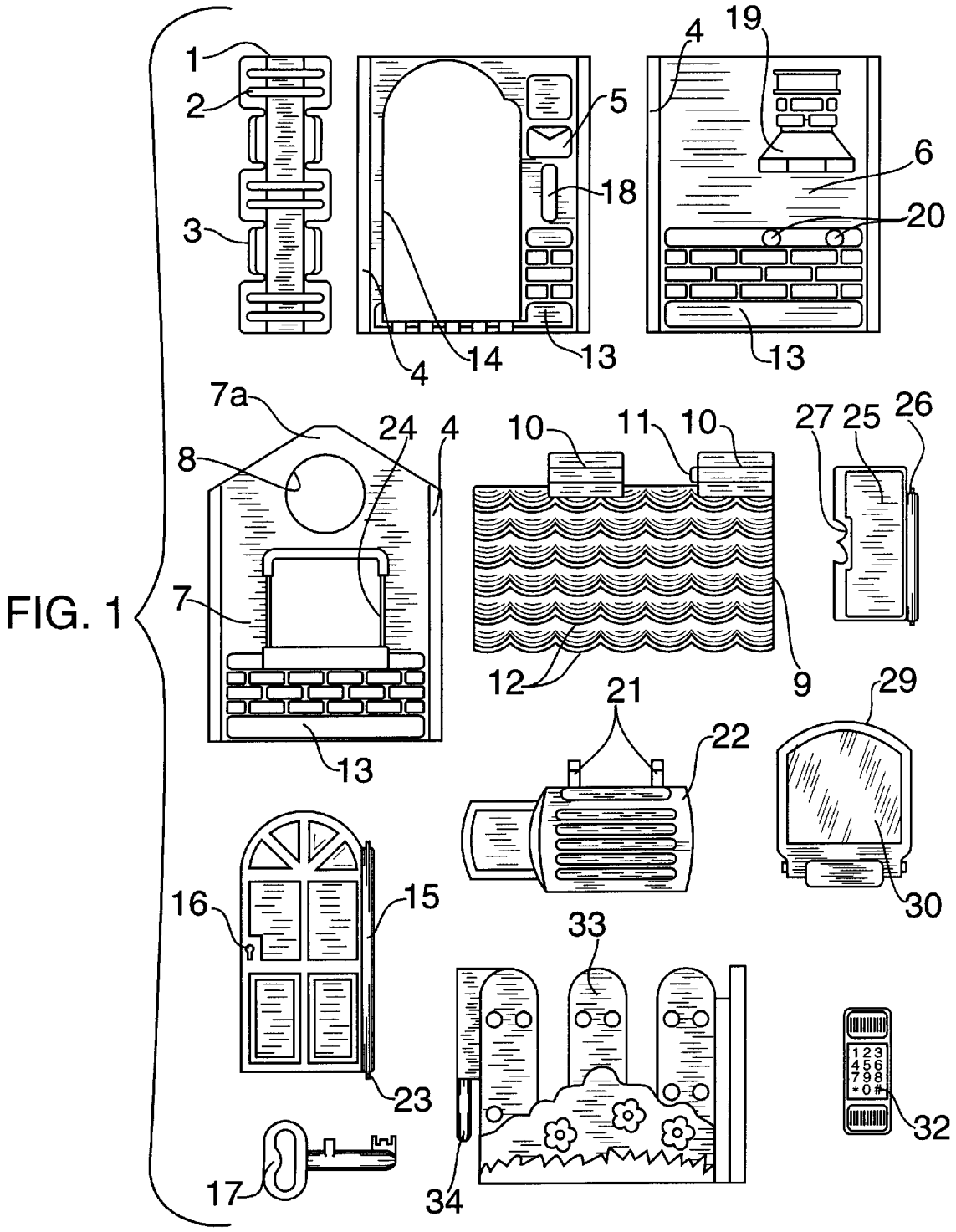
FIG. 1 shows the modular parts altogether making up the construction.
Figure 2:
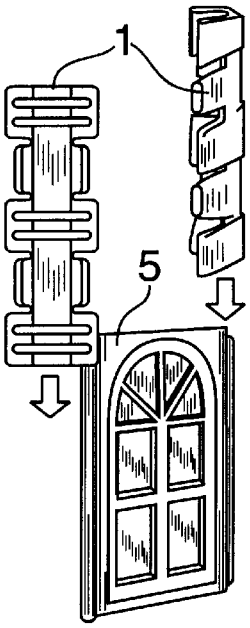
FIGS. 2 to 9 illustrate the successive mounting stages of the parts leading to the house being formed altogether in perspective.
Figure 3:
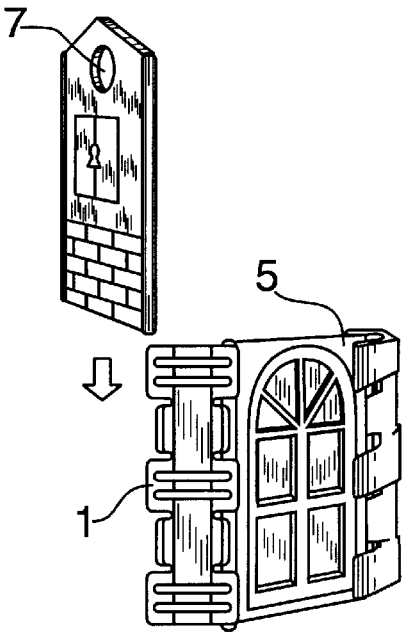
Figure 4:
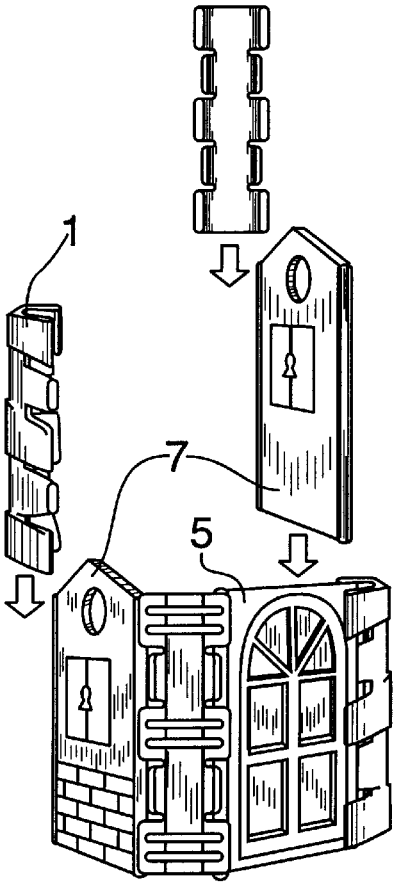
Figure 5:
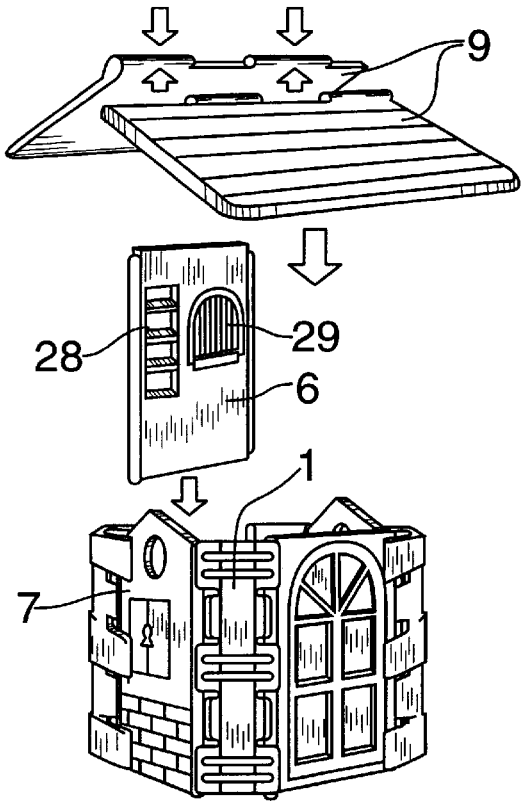
Figure 6:
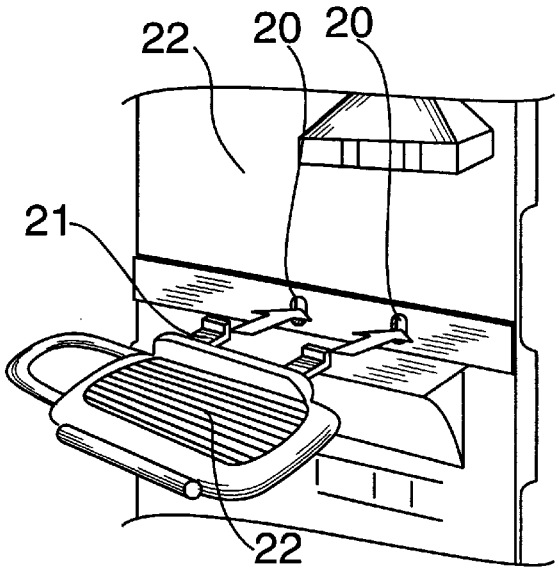

FIG. 2 shows in perspective the initial stage, which comprises connecting the modular connecting parts -1- on either side of part -5-; the modular facades -7- are then mounted, and on them the relevant connecting parts -1- for the remaining part -6-. The result is a prismatic structure, with two of its faces -7- provided with an angular top **-7*a*- defining the inclination of the roof parts -9-**.

As explained above, part -6- has a chimney -19- on its visible face, a built-in cupboard -28- on its inner face and a cavity **-29*a*- in which a flat folding part -29- is housed which, when upright provides a mirror surface -30- and when horizontal provides a flat surface -35- serving as a table. One of the parts -7- has a cavity -31- on its inner face for a telephone -32-** to be located.

Figure 7:
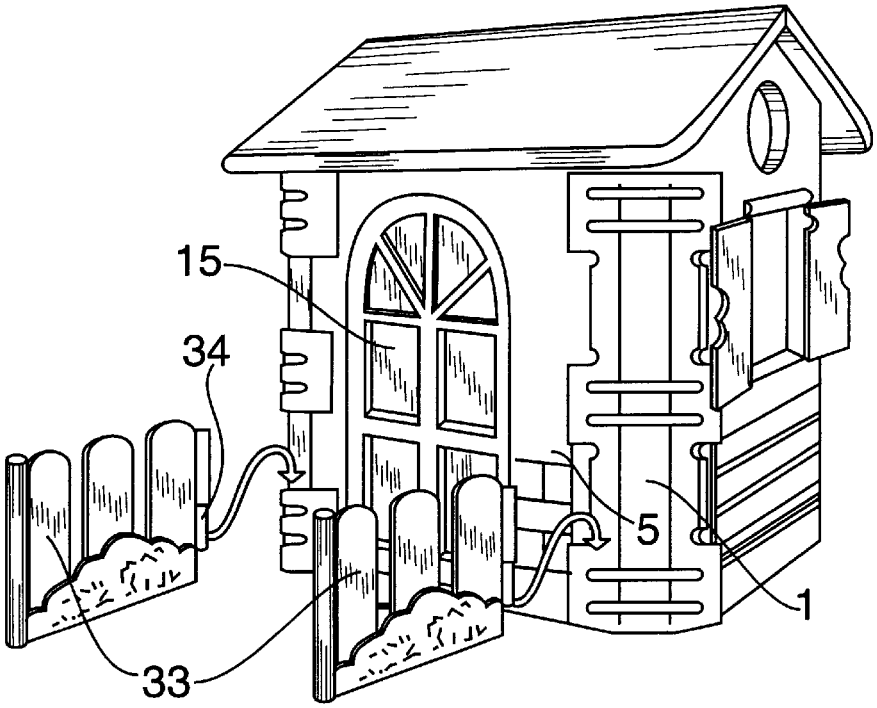
Figure 8:
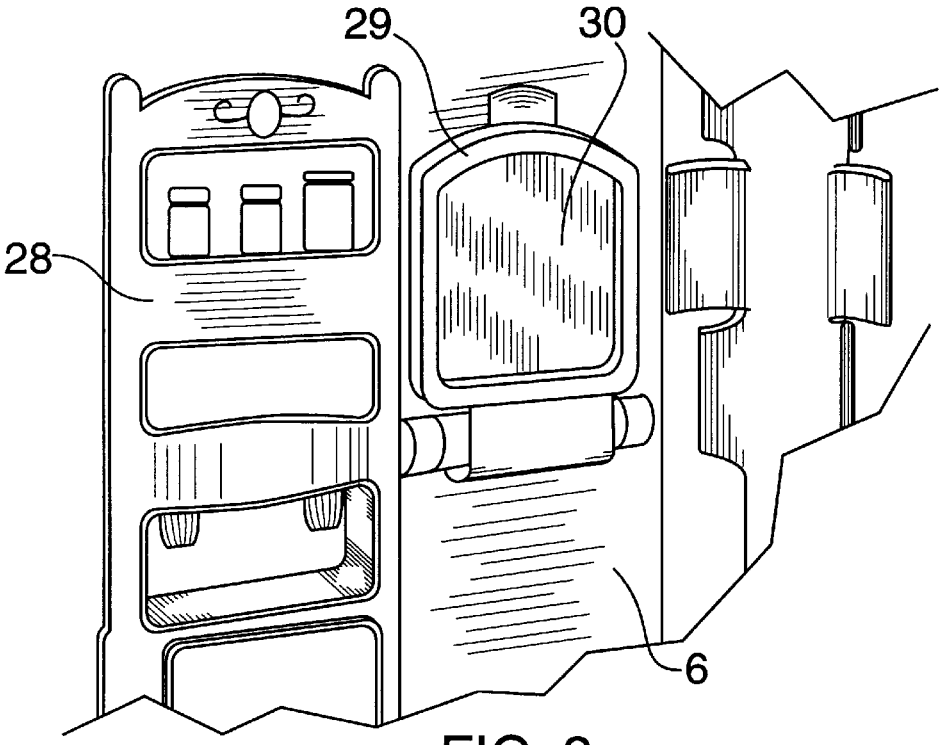
Figure 9:
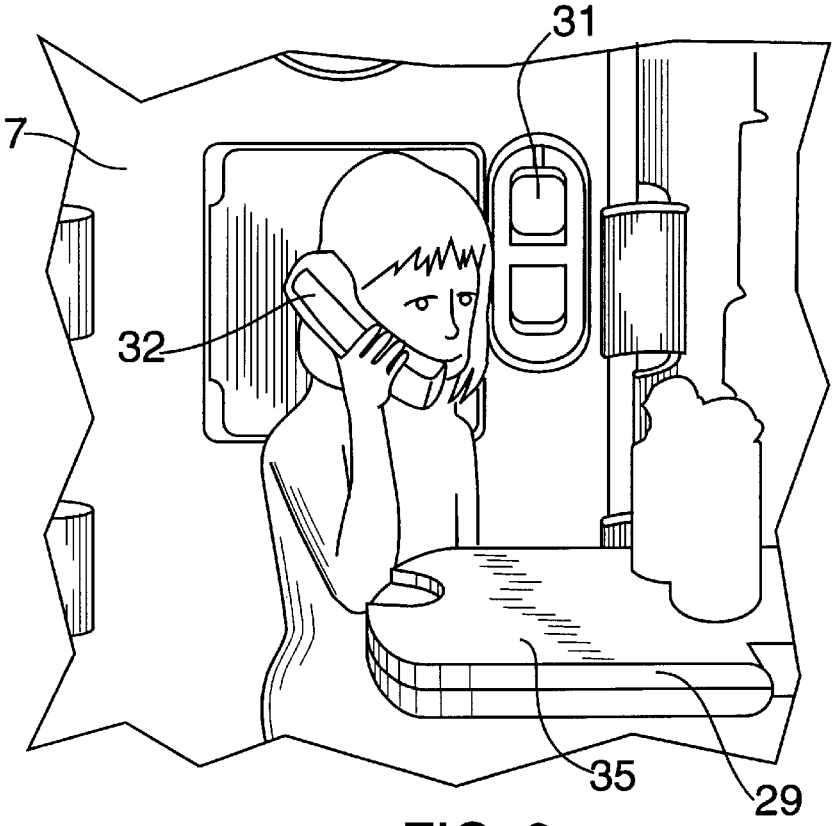

Parts -33- resemble fences fitted with respective shanks -34- to be inserted between parts -1- and panel 5-, as shown in FIG. 7.

The result is a house that is rectangular in plan and has a saddle roof, its approximate dimensions being: 1650 mm×1197 mm×1224 mm.

I claim:

1. A structure for constructing houses designed for children to play, of the kind comprising a plurality of modular corner parts having material extensions projecting from longitudinal vertical sides of said modular corner parts, said extensions extending from and lying at two angles to a body of each of said corner parts, said extensions having on their counter-opposed faces respective recess guides, wherein respective longitudinally extending edges of modular panels slide sufficiently snugly within respective recess guides within each of said extensions in order to establish a linking connection of each of said modular corner parts with a respective corresponding modular panel, said guides extend on either side of said modular panels that are connected at right angles by means of said corner parts, thereby making up prismatic structures with right-angled connections, wherein said modular panels have an embossment thereon resembling stonework or brickwork on respective outer surfaces of said modular panels and a plurality of openings being provided within at least one of said modular panels, each said opening including means for retaining and articulating at least one door leaf and at least one window pane therein, wherein two of said modular panels comprise two opposite facades of said structure, said facades ending in an angle which provides a support for two modular roof parts, said modular roof parts comprising a saddle roof, said modular roof parts being each provided on an edge of a ridge thereof with a built-in connection means, one of said panels having at least one pivotable simulated member pivotable from a vertical position upon said panel to a horizontal position, wherein said pivotable member simulates a domestic mirror surface member in said vertical position and said pivotalable member simulates a domestic flat table top surface member in said horizontal position.

2. A structure for constructing houses designed for children to play, as in claim 1, wherein said means for retaining and articulating said door leaves and window panes in their said respective openings comprise respective coaxial pins extending from a vertical side of said door leaves and said window panes, together with female cavities provided in said respective openings for insertion of said respective coaxial pins therein.

3. A structure for constructing houses designed for children to play, as in claim 1, wherein said built-in connection means connecting said roof parts comprise pairs of rectangular extensions projecting from a side of each ridge, provided with a spigot and a female cavity, corresponding to said spigot, said female cavity receiving said spigot therein.

4. A structure for constructing houses designed for children to play, as in claim 1, wherein a simulated chimney having a respective hood is built into the outer surface of one of said modular panels, and wherein further below said chimney there are provided holes, each said hole receiving a respective bit, each said respective bit projecting from a side of an elongate part resembling a cooking plate.

5. A structure for constructing houses designed for children to play, as in claim 1, wherein one of said modular panels includes a cavity housing said cavity housing holding said at least one pivotable member therein, said at least one pivotable member pivotable about a lower transverse eccentric axis existing on an inner surface of said modular part, said pivotable member provided with said domestic mirror surface member on one side and said flat table top surface member on a reverse side thereof.

6. A structure for constructing houses designed for children to play, as in claim 1, wherein one modular panel of said plurality of modular panels includes an upwardly elongated cavity on its inner face thereof for insertion of a moulded part having an equivalent contour and resembling a removable telephone.

7. A structure for constructing houses designed for children to play, as in claim 1, further comprising a plurality of modular flat-shaped fence parts resembling a fence, said flat-shaped fence parts being provided on one of their vertical sides with a shank of suitable section insertable in a resultant interstice between one of said corner parts and one of said modular panels, each of said flat-shaped fence parts being arranged parallel to one another and at a right angle to said modular panel, on either side of said door leaf.

* * * * *